United States Patent [19]

Tompkins

[11] 4,318,366

[45] Mar. 9, 1982

[54] ECONOMIZER

[75] Inventor: Gene A. Tompkins, Cedarburg, Wis.

[73] Assignee: Aqua-Chem, Inc., Milwaukee, Wis.

[21] Appl. No.: 136,395

[22] Filed: Apr. 1, 1980

[51] Int. Cl.[3] ..... F22B 33/00; F22D 1/02

[52] U.S. Cl. ..... 122/20 B; 122/420; 122/421; 122/412; 165/134 DP

[58] Field of Search ..... 122/20 B, 420, 421, 122/412, 414, 451.1; 165/134 DP, DIG. 12, 66, 101, 103

[56] References Cited

U.S. PATENT DOCUMENTS

| | | | |
|---|---|---|---|
| 2,594,471 | 4/1952 | Marshall | 165/134 DP |
| 2,699,759 | 1/1955 | Kuhner | 122/421 |
| 2,769,619 | 11/1956 | Juhasz | 165/134 DP |
| 4,137,965 | 2/1979 | Fallon, Jr. et al. | 165/134 DP |
| 4,173,949 | 11/1979 | Roethe | 122/412 |
| 4,211,187 | 7/1980 | Farris | 122/20 B |

*Primary Examiner*—Henry C. Yuen
*Attorney, Agent, or Firm*—Fred Wiviott

[57] ABSTRACT

A boiler economizer includes a first heat exchanger disposed in a boiler flue and a second heat exchanger which is external. Boiler feedwater is delivered in series to the first and second heat exchangers before passage to the boiler. A flow controller directs a first portion of the boiler feedwater directly to the first heat exchanger and a second portion is first delivered through the second heat exchanger where it is passed in a heat exchange relation with the feedwater exiting the first heat exchanger. The flow controller is positioned by a temperature transponder which is responsive to the temperature of the discharge flue gases and the feedwater entering the first heat exchanger.

4 Claims, 2 Drawing Figures

ECONOMIZER

BACKGROUND OF THE INVENTION

This invention relates to boiler economizers.

Economizers are commonly employed in connection with boilers to recover a portion of the heat contained in the exiting flue gases. Typically, such economizers include a heat exchanger in the flue which preheats the boiler feedwater. One problem with such economizers is that if the temperature of the flue gas is lowered below the dew point of entrained acid vapors, highly corrosive acids may be formed. In order to minimize such corrosion, many prior art economizers limited the amount of heat recovered from flue gases, thereby lowering overall system efficiency.

One prior art type of economizer system which attempted to increase heat recovery during high boiler firing rates also included ductwork and dampers for routing the flue gases around the economizer at lower boiler firing rates at which corrosive acids might normally be formed. The economizer would then be sized for operation at higher firing rates only. This type of system was not wholly satisfactory, however, because heat could not be recovered from flue gases bypassed in this manner. Further, such ductwork is relatively costly to install and in addition, could not be employed universally because of substantial space requirements.

Another prior art economizer diverts a portion of the feedwater around the economizer at lower firing rates. With a smaller quantity of water flowing through the economizer, the flue gas temperature tended to remain higher. However, in many instances, the inlet water temperature would be cool enough to allow some flue gas condensation, causing cold end corrosion. Also, if the economizer size is increased for maximum heat recovery, low fire flow can be so low as to cause steaming.

Yet another prior art economizer system controls inlet water temperature by the use of an external heating source. Heat was added to the inlet water by means of steam heat or a heat exchanger located in the lower boiler drum. The effectiveness of such systems was limited by the steam or boiler water temperature, which in low pressure boilers, may not be sufficient to prevent corrosion. In addition, such systems could not be substantially self-contained because of the requirement for additional piping. Further such systems had a poor response time and were difficult to control.

SUMMARY OF THE INVENTION

It is an object of the invention to provide a new and improved economizer for boilers.

A further object of the invention is to provide a boiler economizer which is efficient and which is not subject to cold and corrosion.

Another object of the invention is to provide a boiler economizer which recovers a maximum of heat from flue gases without corrosion at all firing conditions.

Yet another object of the invention is to provide a boiler economizer which is substantially self-contained.

These and other objects and advantages of the present invention will become more apparent from the detailed description thereof taken with the accompanying drawing.

A further object of the invention is to provide a boiler economizer which is effective regardless of fluctuations in water flow rates, flue gas temperatures and differences in flue gas dew point temperatures.

DESCRIPTION OF THE PREFERRED EMBODIMENT

Figure 1:
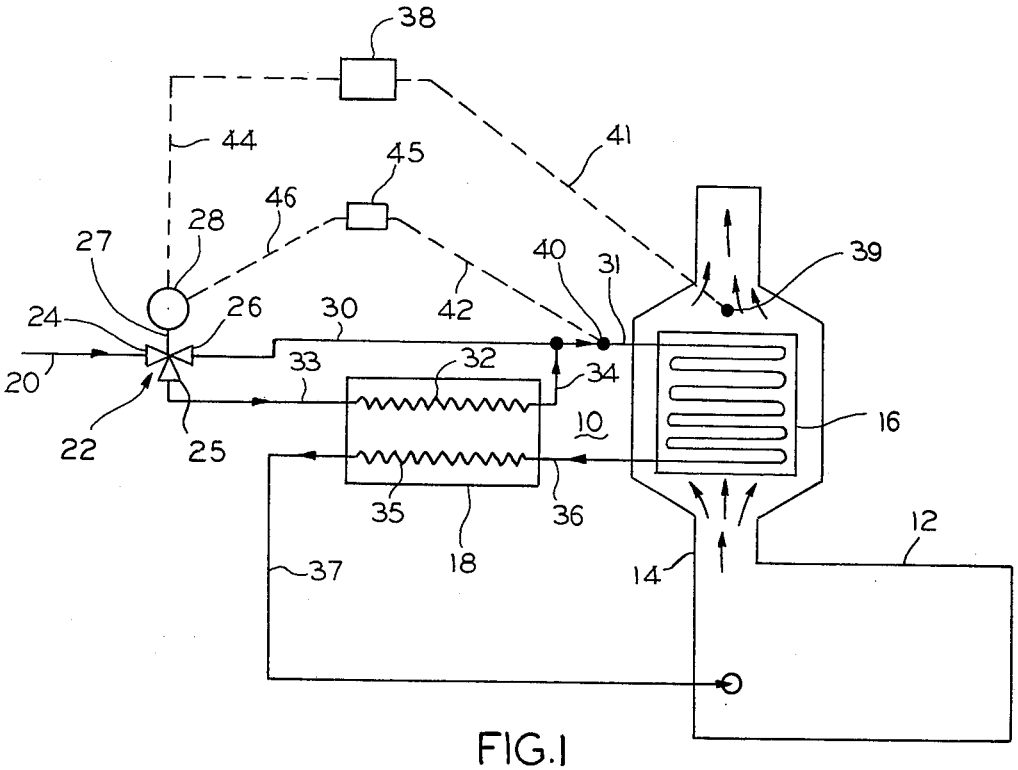
FIG. 1 schematically illustrates a boiler economizer in accordance with the present invention.

FIG. 1 schematically illustrates an economizer system 10 as applied to a boiler 12. As those skilled in the art appreciate, boiler 12 may be of the watertube or firetube type. In either case, it is necessary to provide boiler makeup feedwater to replace water which may be withdrawn from the boiler in the form of steam, hot water or blow-down. In addition, the boiler 12 includes a furnace (not shown) connected to a flue 14 in which the products of combustion are discharged.

The economizer system includes a first heat exchanger 16 disposed in the furnace flue 14 and a second heat exchanger 18 which is external to the flue. Boiler feedwater is delivered by pipe 20 to a three-way proportioning valve 22 having an inlet 24 and outlets 25 and 26. While the details of valve 22 form no part of the invention, it will be sufficient for purposes of understanding the invention to state that the valve includes a movable element 27 whose position determines the proportion of water at inlet 24 which will be diverted through each outlet 25 and 26. An actuator motor 28 is connected to element 27 by means of a stem 29 and is operative to position the element 27 in accordance with a received electrical signal. The valve may, for example, be a Honeywell Model 4907 and the actuator motor a Honeywell model M940B.

A first pipe 30 is connected at one end to the valve outlet 26 and at its other end to the inlet 31 of the first heat exchanger 16. The second heat exchanger 18 includes a first flow path 32 connected by pipes 33 and 34 between the valve outlet 25 and pipe 30 the inlet 31 of heat exchanger 16 and a second flow path 35 connected by pipes 36 and 37 between the outlet of the first heat exchanger 16 and the boiler 12. Flow paths 32 and 35 are constructed and arranged to exchange heat between fluids flowing therein.

The motor 28 is controlled by a temperature responsive proportioning controller 38. Coupled to controller 38 is a first temperature probe 39 disposed in the flue 14 adjacent the cold end of heat exchanger 16 and a second temperature probe 40 disposed at the inlet of heat exchanger 16. The probes 39 and 40 are preferrably thermocouples which provide electrical input signals to controller 38 through leads 41 and 42, respectively, and which are functionally related to the sensed temperature. The controller 38 is operative to provide an output signal at lead 44 which is functionally related to the difference between the temperature at probe 39 and a value which is preset. While any well known controller may be employed, one which has been found to be satisfactory is Honeywell Dialatrol Proportioning Controller Model No. R7352.

An additional controller 45 is operative when the temperature at probe 40 falls below some preset value to override the signal from probe 39 to provide a signal on conductor 46 which positions element 27 so as to divert all of the feedwater through heat exchanger 18.

Figure 2:
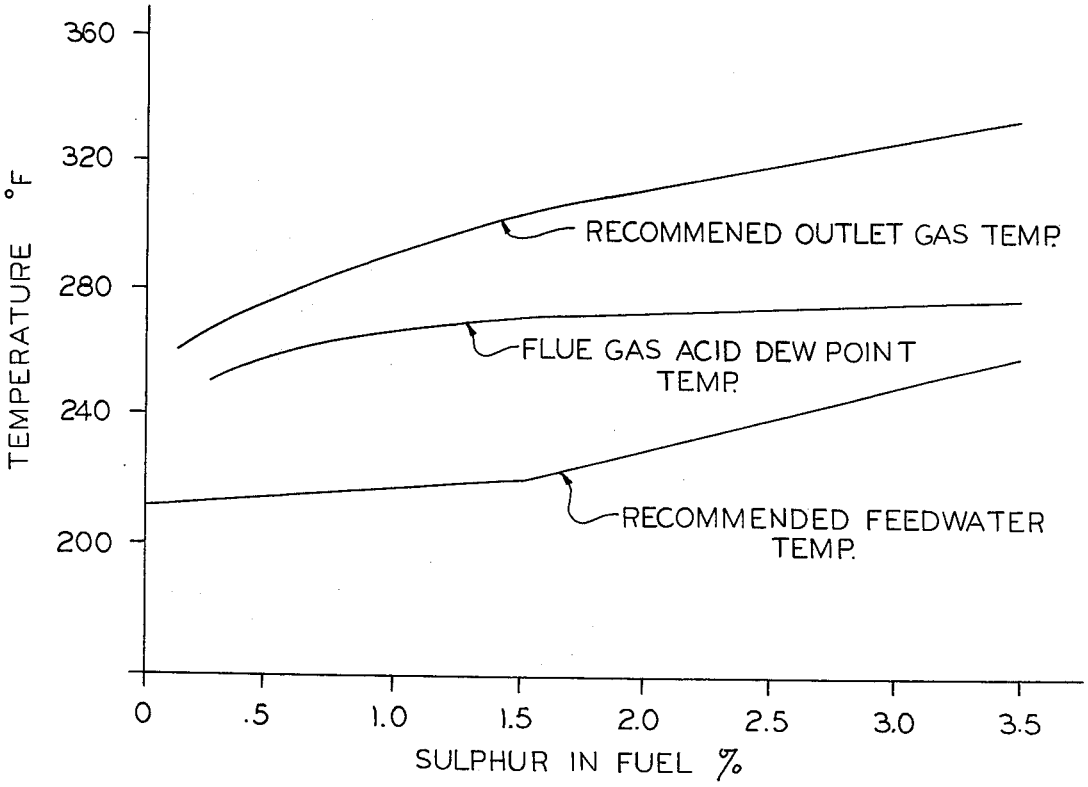
FIG. 2 shows the relationship between fuel sulpher content, the dew point of $H_2SO_4$ and flue gas and feedwater temperature desirable to minimize corrosion.

Most modern boilers are constructed and arranged to burn selectively one of a plurality of fuels, such as gas or light or heavy oil, depending upon the cost and availability of each. One of the variables in such fuels is the percentage sulphur content. For example, representative sulphur contents of typical fuels is 0–0.4% for natural gas, 0.2–1.0% for No. 2 fuel oil and 0.7–4% for No. 6 fuel oil. When sulphur containing fuel is burned in a typical boiler, sulphuric acid vapor is formed. Should such vapor condense, highly corrosive acid will be formed on the heat exchanger 16 and other metallic components of the flue 14. The relationship that the dew point of such vapor bears to the flue gas temperature and the percent of sulphur content of the fuel is indicated at 46 in FIG. 2 which indicates the dew point of sulphuric acid increases in relation to the percentage of sulphur in the fuel.

The economizer according to the invention controls the flue gas temperature so that there will be a maximum heat recovery without condensation of corrosive sulphuric acid. In order to achieve this result, the feedwater should have a preselected minimum value for any particular flue gas condition. Toward this end, the controller 38 positions the element 27 so that the relative portions which are heated in heat exchanger 18 and which remain unheated will provide the correct temperature at the inlet 31 of heat exchanger 16. Depending upon the position of element 27, a first portion of the feedwater will be diverted through flow path 32 of heat exchanger 18 and a second portion will be bypassed around heat exchanger 18 through pipe 30. It will also be appreciated that the temperature of the water passing through the first heat exchanger 16 will be elevated as heat is transferred from the flue gases. As a result, the temperature of the flue gases will be lowered and that of the feedwater elevated. The feedwater heated in heat exchanger 16 will then pass through flow path 35 of heat exchanger 18 in a heat exchange relation with unheated feedwater passing through flow path 32 from the outlet 25 of valve 22. After the incoming feed water exits the heat exchanger 16 it mixes with the relatively lower temperature feedwater in pipe 30 and the mixture passes to the heat exchanger 16. In this manner, the position of element 27 which dictates the proportion of feedwater flowing to outlets 25 and 26 will control the temperature of feedwater flowing to the heat exchanger 16.

Should the temperature of the flue gases at the cold end of heat exchanger 16 decrease as measured by probe 39, it will be necessary to increase the temperature of the feedwater passing to inlet 31. This condition is sensed by probe 39 and the resultant signal actuates controller 38 which provides a repositioning signal to motor 28 so that element 27 will be repositioned to pass a larger proportion of water through flow path 32 of heat exchanger 18. However, should the temperature sensed by probe 39 rise above the preset level, indicating that insufficient heat is being recovered from the flue gases, element 27 will be repositioned so that a lower proportion of the feedwater will be diverted through flow path 32 so that the temperature of the water passing to heat exchanger 16 will be lowered, whereby the heated recovery level will increase.

In one example of the method, No. 2 fuel oil was burned in a Cleaver-Brooks Model Delta 42 water tube boiler at 4500 pounds of steam per hour or about 1/6 capacity. Here, the flue gas temperature was about 386° F., the flue gas flow rate about 5700 pounds/hour and feedwater temperature at about 225° F. was delivered to pipe 20 at the rate of 4500 pounds/hour. Under these conditions, the dew point of the flue gases would typically be about 258° F. Therefore, the controller 38 was set such that the temperature at the cold end of the heat exchanger 16 as measured by probe 39 was maintained at 283° F. In order to maintain this flue gas temperature, the temperature of the feedwater entering the inlet 31 of heat exchanger 16 was measured at 279° F. and the temperature at the outlet 37 was 311° F. while the temperature of the water exiting heat exchanger 18 for passage to the boiler through pipe 36 was 255° F.

When the same boiler was operated on No. 2 fuel oil at 67% of capacity, i.e., with steam production at 18000 lbs./hr., the gas temperature at the outlet of the boiler was 486.3° F. and the flow rate 19740 lbs./hr. With a feedwater temperature of 225° F., and a flow rate of 18000 lbs./hr. the controller 38 was set so that the temperature probe 39 was again 283° F. because use of the same fuel would result in the same $H_2SO_4$ condensation temperature. Under these operating conditions, the temperature at the inlet of heat exchanger 16 was measured at 254.4° F. and 310.4° F. at the outlet 37.

Normally, the controller 38 will position element 27 under the influence of probe 39 to adjust for changes in feedwater temperature also. However, should the feedwater temperature at inlet 31 of heat exchanger 16, as sensed by probe 40, fall below a predetermined value, controller 38 will reposition element 27 to increase the feedwater temperature. This insures that the feedwater temperature does not fall below levels which might result in acid vapor condensation even though such low water temperature are not yet reflected in a reduced flue gas temperature.

The heat recovery system according to the present invention is substantially self-contained and a compact system which can be installed in existing boilers without substantial additional space requirements. Further, because all of the feedwater flows through heat exchanger 16, it can be sized for maximum operating conditions without substantial risk of steaming at lower temperatures. Accordingly, the flue discharge gas temperature can be controlled and heat recovery can be maximized while providing corrosion protection. In addition, substantially all of the usable heat can be recovered without corrosion problems at all boiler firing rates. Also, the system can be employed with fuels having different dew points while maintaining optimum heat absorption.

While only a single embodiment of the invention has been illustrated and described, it is not intended to be limited thereby but only by the scope of the appended claims.

I claim:

1. In combination with a boiler having a combustion chamber and a flue, a first heat exchanger disposed in said flue for exchanging heat between boiler feed liquid and gaseous combustion products in said flue, flow dividing means having first and second outlets and an inlet connected to receive boiler feed liquid and having adjustable proportioning means for providing a first portion of said liquid to said first outlet and a second portion to said second outlet, a second heat exchanger disposed exteriorly of said boiler and said flue and having a first flow path and a second flow path for exchanging heat with liquid flowing in said first flow path, said first flow path being connected in series between said first outlet and said first heat exchanger and said boiler, said second outlet being connected to said first heat exchanger in a parallel relation to said first flow path, temperature responsive means disposed in said flue for measuring the temperature of gaseous combustion products in said flue after passage thereof over said first heat exchanger and for positioning said proportioning means to maintain the proportion of feed liquid flowing at each outlet so as to maintain the temperature of said combustion products at a preselected level solely with heat extracted from said flue gases.

2. The combination set forth in claim 1 wherein said first heat exchange means has an inlet for receiving feed liquid from said first and second flow paths, said temperature responsive means also include means for measuring the temperature of said feed liquid at said inlet and for adjusting the flow control means to increase the flow of feed liquid to said second flow path when the temperature of said feed liquid accidentally falls to a preselected level.

3. An economizer for recovering heat from flue gases discharging from a boiler combustion chamber flue comprising:

a first heat exchanger disposed in said flue for exchanging heat between a boiler feed liquid and said flue gases, a second heat exchanger disposed exterior of said boiler for exchanging heat between unheated feed liquid flowing to said first heat exchange means and heated feed liquid flowing to said boiler from said first heat exchanger means, an adjustable flow controller having an inlet connected to receive feed liquid and a first outlet connected to said first heat exchanger for delivering a first portion of the unheated feed liquid directly to said first heat exchanger and around the second heat exchanger means and a second outlet connected to the second heat exchanger for delivering a second portion of the unheated feed liquid to the first heat exchanger through the second heat exchanger, means for coupling said first heat exchange means for delivering said feed liquid to said boiler and through said second heat exchange means, temperature responsive means coupled to said flow control means and to said flue and operative in response to the temperature of the flue gases after the latter have exchanged heat with the feed liquid flowing through said first heat exchange means to relatively adjust said flow control means whereby the first and second portions of feed liquid flowing to said first heat exchange means and to said second heat exchange means are adjusted for maintaining the temperature of said flue gases at a preselected value, said economizer transferring waste heat from said flue gases to said feed liquid without withdrawing heat from said boiler said feed liquid being preheated solely with waste heat in said flue gases.

4. A method of controlling the flue gas temperature in a boiler comprising the steps of:

providing a first heat exchanger in the flue of said boiler and a second heat exchanger outside of said boiler, dividing boiler feed liquid into first and second portions, delivering said first feed liquid portion directly to said first heat exchanger and said second portion to a first flow path of said second heat exchanger, exchanging heat in said first heat exchanger between said feed liquid and the flue gases within said flue for recovering heat therefrom, withdrawing said heated liquid from said first heat exchanger and passing the same to a second flow path of said second heat exchanger, exchanging heat in said second heat exchanger between said feed liquid flowing in said first and second flow paths, measuring the temperature of said flue gases after the exchange of heat with said feed liquid in said first heat exchanger, adjusting the relative proportion of said first and second feed liquid portions in relation to said flue gas temperature to maintain said flue gas temperature at a preselected temperature level, and delivering said feed liquid from said second flow path to said boiler as the feed liquid thereto.

* * * * *